US006633128B2

(12) United States Patent
Ilyés et al.

(10) Patent No.: US 6,633,128 B2
(45) Date of Patent: Oct. 14, 2003

(54) DISCHARGE LAMP WITH SPIRAL SHAPED DISCHARGE TUBE

(75) Inventors: László Ilyés, Erdökertes (HU); József Tökés, Budapest (HU); József Fülöp, Budapest (HU)

(73) Assignee: General Electric Company, Schenectady, NY (US)

( * ) Notice: Subject to any disclaimer, the term of this patent is extended or adjusted under 35 U.S.C. 154(b) by 131 days.

(21) Appl. No.: 09/867,205

(22) Filed: May 29, 2001

(65) Prior Publication Data

US 2002/0180352 A1 Dec. 5, 2002

(51) Int. Cl.[7] ..... H01J 17/16; H01J 61/30
(52) U.S. Cl. ..... 313/634; 313/493; 313/635
(58) Field of Search ..... 313/573, 634, 313/493, 318.02, 635, 637, 485; 362/216; 439/227

(56) References Cited

U.S. PATENT DOCUMENTS 5,680,005 A * 10/1997 Soules et al. ..... 313/493
5,925,978 A * 7/1999 Holzer ..... 313/493

FOREIGN PATENT DOCUMENTS

| | | |
|---|---|---|
| DE | 212 843 | 8/1984 |
| DE | 41 33 077 A1 | 4/1993 |

* cited by examiner

*Primary Examiner*—Nimeshkumar D. Patel
*Assistant Examiner*—Jason Phinney
(74) *Attorney, Agent, or Firm*—Fay, Sharpe, Fagan, Minnich & McKee, LLP

(57) ABSTRACT

A low-pressure discharge lamp with a double spiral shaped discharge tube including two spiral shaped tube portions. The tube portions define a central axis of the discharge tube. A cold chamber portion connects the ends of the spiral shaped tube portions. The cold chamber portion has a first transversal dimension substantially perpendicular to the central axis which is larger than the diameter of the tube portions. The cold chamber portion further has a second transversal dimension substantially parallel to the central axis. The second transversal dimension of the cold chamber portion substantially corresponds to the diameter of the tube portions.

13 Claims, 3 Drawing Sheets

DISCHARGE LAMP WITH SPIRAL SHAPED DISCHARGE TUBE

FIELD OF THE INVENTION

This invention relates to a low-pressure discharge lamp comprising a double spiral shaped discharge tube which includes two spiral shaped tube portions. The lamp is provided with a cold chamber portion connecting the ends of the spiral shaped tube portions.

BACKGROUND OF THE INVENTION

Low pressure discharge lamps are well known in the art. These lamps contain small doses of mercury which radiates under the influence of the discharge arc. In order to achieve maximum light output, it is required that the mercury vapour is adjusted and stabilized on a well-defined partial pressure. This is possible by forming a so-called cold chamber on the discharge tube, and by selecting the appropriate temperature in the cold chamber which is the coldest point of the gas discharge tube.

A spiral-shaped compact fluorescent lamp is disclosed in the Patent No. DD 212 843 published in the former German Democratic Republic. This lamp comprises a straight gas discharge tube portion surrounded by another spiral-shaped gas discharge tube portion with one thread. This known lamp has not prevailed in the practice, since the manufacturing of the two different gas discharge tube portions with different shapes requires two separate production lines which increases production cost. Also, the overall visual appearance of the lamp and its light distributions is not completely satisfactory.

German Patent Application No. DE 41 33 077 discloses another spiral shaped discharge lamp, but with a double spiral shaped discharge tube. In this known discharge lamp, the cold chamber is positioned at the top of the lamp, between the two ends of the tube portions constituting the strands of the double spiral. The cold chamber is formed by an annular widening of the discharge tube. However, the light distribution of the lamp in the region of the cold chamber still needs improvement because a relative large portion of the enveloping surface is not utilized as lighting surface, particularly in the direction along the axis of the lamp, towards the end which is further away from the lamp housing. This is of particular importance when the lamp is screwed in a socket on the ceiling, with the cold chamber facing downwards.

Therefore, there is a need for a discharge lamp which exhibits improved light distribution also at the top of the lamp, and which has an efficient cold chamber for optimal performance of the lamp, while the possibility of an economic manufacturing of the discharge tube is also maintained.

SUMMARY OF THE INVENTION

In an embodiment of the present invention, there is provided a low-pressure discharge lamp comprising a double spiral shaped discharge tube. The discharge tube includes two spiral shaped tube portions. The tube portions define a central axis of the discharge tube, in the sense that each of the tube portions are wound around a theoretical axis, and the two axis substantially coincide. A cold chamber portion connects the ends of the spiral shaped tube portions. The cold chamber portion has a first transversal dimension, the first transversal dimension being defined as a transversal dimension measured substantially perpendicular to the central axis. This first transversal dimension of the cold chamber portion is larger than the diameter of the tube portions. The cold chamber portion has a second transversal dimension. This second transversal dimension is measured substantially parallel to the central axis. The second transversal dimension of the cold chamber portion substantially corresponds to the diameter of the tube portions.

The lamp with the cold chamber portion of the above described design has an improved luminance distribution combined with enhanced mechanical stability, as compared with known cold chamber designs. The cold chamber portion and the two tube portions of the discharge tube may be easily formed starting from a single integral glass tube, thereby avoiding imperfect joints between discharge tube sections.

BRIEF DESCRIPTION OF DRAWINGS

The invention will now be described with reference to the enclosed drawings, where.

DETAILED DESCRIPTION OF THE INVENTION

Figure 1:
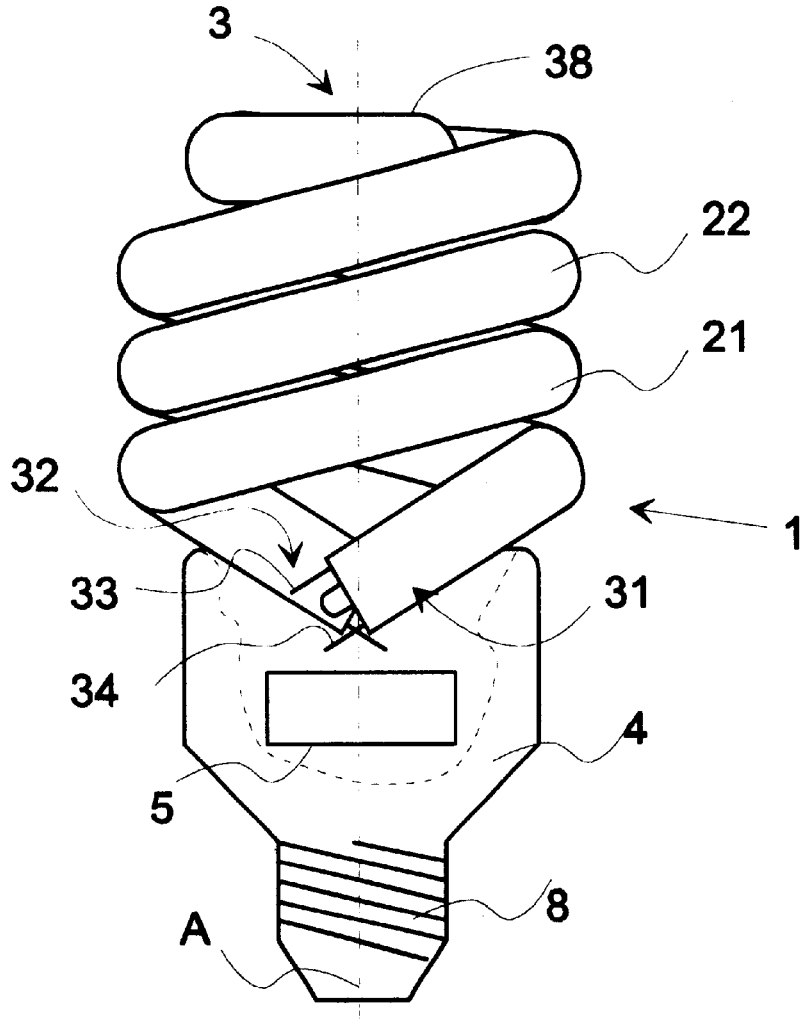
FIG. 1 is a partly broken-out elevation view of a spiral shaped low pressure discharge lamp with a chamber formed at the top of the discharge tube.
Figure 2:
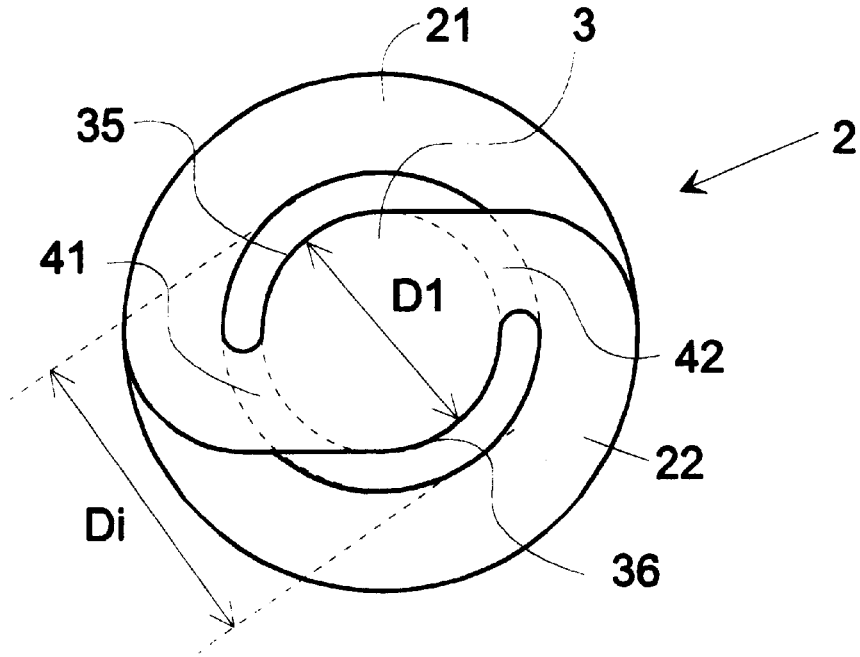
FIG. 2 is a top view of the spiral shaped low pressure discharge lamp shown in FIG. 1.

Referring now to FIGS. 1 and 2, there is shown a low pressure arc discharge lamp 1. The lamp 1 has a discharge tube 2 with sealed ends 31, 32. The lamp 1 of FIG. 1 has two spiral shaped discharge tube portions 21 and 22 which are interconnected through a cold chamber portion 3 at the upper ends of the tube portions 21 and 22.

The discharge tube 2 is mechanically supported by a lamp housing 4. The lamp housing 4 surrounds the sealed ends 31,32 of the discharge tube 2. More precisely, the sealed ends 31,32 of the tube portions 21,22 are within the lamp housing 4, while the major part of the tube portions 21,22 is external to the lamp housing 4. The lamp 1 is of a type where light is emitted by a phosphor layer deposited on the inner surface of the discharge tube 2, the phosphor being excited by a discharge arc. The electrons of the discharge arc are emitted from a heated filament (not shown). The filaments are contained at the sealed ends 31,32 of the discharge tube 2. Such a discharge lamp arrangement is known by itself. The lamp housing 4 also contains the electronic ballast circuit 5 of the lamp. In a typical embodiment, the lamp housing 4 is equipped with a screw terminal 8 which fits into a standard screw socket (not shown).

As best seen in FIG. 1, and explained above, the low-pressure discharge lamp 1 comprises a double spiral shaped discharge tube 2 including two spiral shaped tube portions 21,22. The discharge tube 2 is wound around a central axis A. Thus the discharge tube 2 itself is formed from the spiral shaped discharge tube portions 21,22. With other words, the spirally wound discharge tube portions 21,22 constitute a double spiral thread, which are joined to each other via the cold chamber portion 3 around the central axis A. The pitch of the discharge tube portions 21 allows the joining of the tube portions, i. e. enough space is left among the threads of a tube portion to accommodate the threads of the other discharge tube portion. Thus the discharge tube 2, which constitutes in practice the bulb of the lamp 1, forms a double spiral.

The sealed ends 31,32 of the discharge tube 2 are located within the lamp housing 4. These sealed ends 31,32 are gas proof, and the electrodes 33,34 are connected to the ballast circuit 5. Such an arrangement is well known per se.

Figure 5:
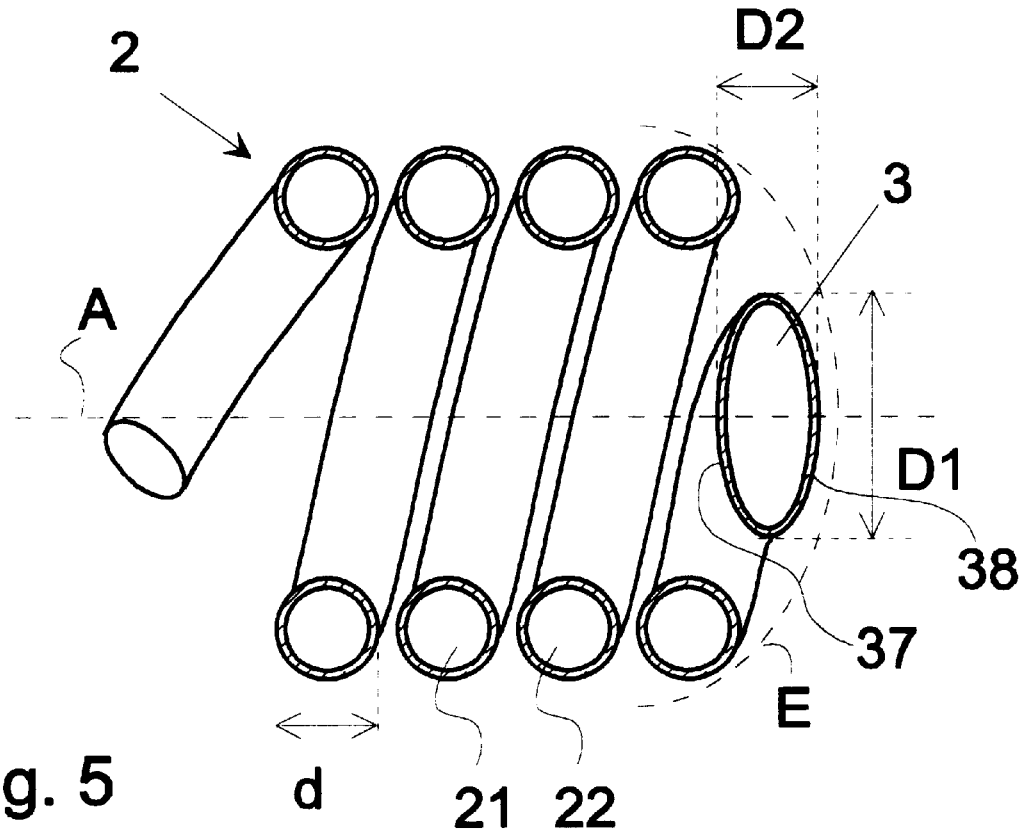
FIG. 5 is a cross section of the discharge tube of the lamp shown in FIG. 4, taken along the line V—V.
Figure 6:
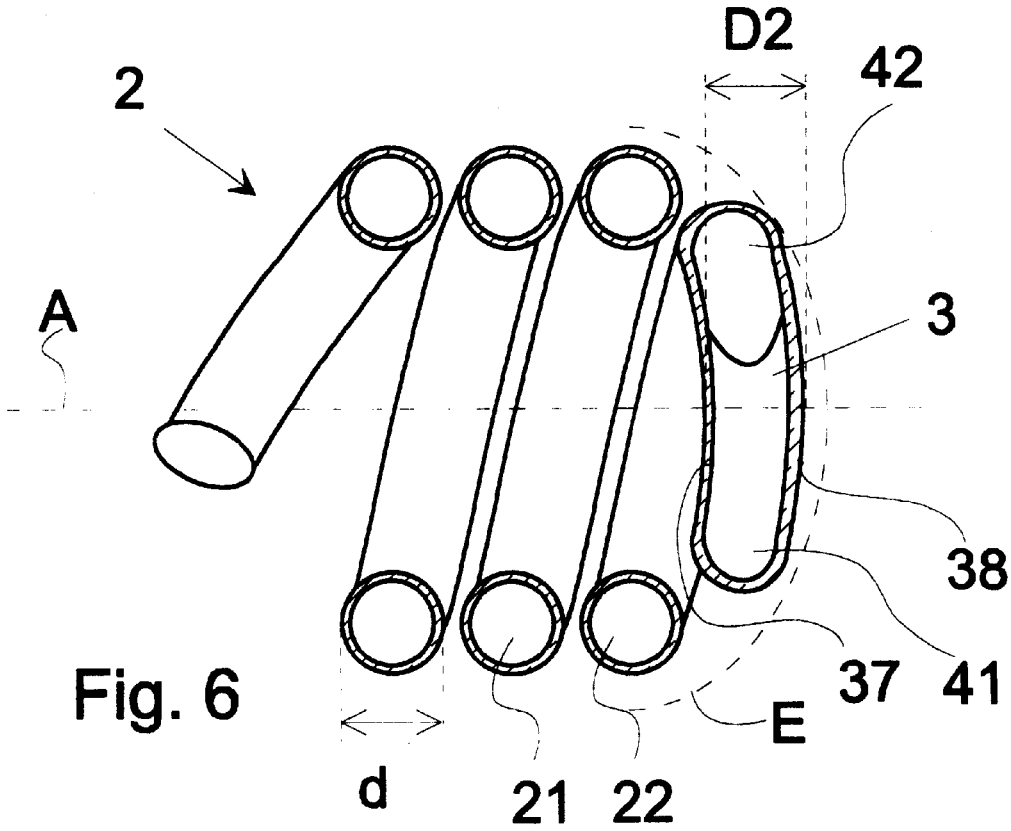
FIG. 6 is another cross section of the discharge tube of the lamp shown in FIG. 4, taken along the line VI—VI.

As best seen in FIGS. 1, 5 and 6, the tube portions 21,22 define the central axis A of the discharge tube, and the cold chamber portion 3 connects the upper ends of the spiral shaped tube portions 21,22, i. e. those ends opposite to the sealed ends 31,32. The cold chamber portion 3 has a first transversal dimension D1. This transversal dimension D1 is measured substantially perpendicular to the central axis A. The first transversal dimension D1 of the cold chamber portion 3 is larger than the diameter d of the tube portions 21,22. The cold chamber portion 3 also has a second transversal dimension D2, which is measured substantially parallel to the central axis A. The second transversal dimension D2 of the cold chamber portion 3 substantially corresponds to the diameter d of the tube portions 21,22. This second transversal dimension D2 is essentially the height of the cold chamber portion 3 if the lamp is considered to be in the upright position as shown in FIG. 1.

The cold chamber formed in this manner satisfies a number of requirements. As mentioned above, it is desirable to provide a relatively large illuminated surface 38 towards the top of the lamp. The surface of the cold chamber may be utilised as such an illuminated surface. However, the total surface of the cold chamber, and particularly, the volume of the cold chamber may not be selected arbitrarily. When forming a cold chamber for a discharge lamp, care must be taken to avoid an oversized cold chamber, which would mean that some parts of the cold chamber wall are too far from the discharge arc, and thereby results in a cold spot with an average temperature below the optimum value of approx. 37° C.

Also, it is generally desirable to bring the discharge arc as close to the wall of the discharge tube as possible, i. e. there is a tendency to make the diameter of the discharge tube as small as possible. With thin discharge tubes, a relatively small annular widening of the tube would be enough to provide an efficient cold chamber, but the useful light emitting surface of the cold chamber would still be relatively small. This is because with an annular widening or expansion of the discharge tube, the volume increases proportional to the third power of the size, while the surface increases proportional to the second power only.

If the widening or expansion of the discharge tube is made along one dimension only, as shown in the figures, the increase in volume is approximately proportional with the second power of amount of the widening, and the same applies to the increase in the surface. Therefore, the surface 38 of the cold chamber portion which is useful as a lighting surface will increase linearly proportionally with the volume of the resulting cold chamber.

Typically, the diameter d of the discharge tube 2 at the tube portions 21,22 is between 10–15 mm, the wall thickness being 0.8–1.2 mm. The first transversal dimension D1 of the cold chamber portion is approx. the double of this value, i. e. the value of D1 is between 20–30 mm for a typical lamp of approx. 100 W luminous power.

It is noted that the temperature of the cold spot on the cold chamber portion 3 may be also influenced by the wall thickness of the cold chamber portion 3. Therefore, it is foreseen that the wall thickness is reduced at least in some regions of the cold chamber 3. The reduced thickness may be as low as 0.4 mm. The reduced wall thickness is achieved when the cold chamber portion 3 is formed, e. g. by blowing or casting the glass into a properly shaped mold.

In a possible embodiment of the lamp 1, the cold chamber portion 3 has a substantially circular cross section, taken in a plane substantially perpendicular to the central axis A. Such a cold chamber arrangement is shown in FIG. 2. It is well visible that the cold chamber portion 3 has a transversal dimension D1 larger than the diameter d of the tube portions 21,22. In the embodiment shown in FIG. 2, the transversal dimension D1 is effectively equal to the diameter of the cold chamber portion 3, and it is smaller than the inner diameter Di of the double spiral constituted by the tube portions 21,22, but advantageously D1 is almost as large as Di, which means that practically the whole upper part of the enveloping surface of the discharge tube 2 appears as a light emitting surface.

It is also best seen in FIG. 2 that the cold chamber portion 3 is naturally perceived to have a circular cross section if at least a wall section 35 of the cold chamber portion 3 is concentric with an opposing wall section 36. In this case, it is straightforward to define the first transversal dimension D1 of the cold chamber portion as the distance between the concentric wall sections 35,36, i. e. the diameter of the circular cold chamber portion 3.

The discharge lamp 1 functions as follows. The ballast circuit 5 assembled in the lamp housing 4 generates the voltage with appropriate parameters from the mains circuit voltage. This brings the gas fill of the discharge tube 2 into discharge state. The fill gas is an inert gas, for example argon, complemented by mercury for the purposes of light excitation. The mercury is excited by the discharge to emit UV radiation, and the UV emission is converted to visible light by the phosphor applied to an inner surface of the discharge tube 2.

As explained above, the discharge tube 2 also comprises a cold chamber portion 3 with the shape as described above. The cold chamber portion 3 makes the adjustment of the partial gas pressure of mercury possible, in the manner that the partial vapour pressure will cause the excitation of the 253.4 nm resonance line of the mercury, i. e. the line with the highest emission intensity. That part of the mercury vapour adjoining its liquid phase, which causes higher vapour pressure than required, is condensed in the cold chamber.

In contrast, when the vapour pressure of mercury is lower than required, an appropriate portion of the mercury condensed in the cold chamber is brought into the vapour phase. Therefore, the luminous flux performance of the discharge lamp can be adjusted to the highest value along with a given power consumption. As noted above, the inside of the cold chamber portion 3 is also covered with light emitting material which means that the cold chamber portion also contributes to the total light output of the lamp. Due to the relatively large upper surface 38 of the cold chamber portion, this contribution is significant.

Figure 3:
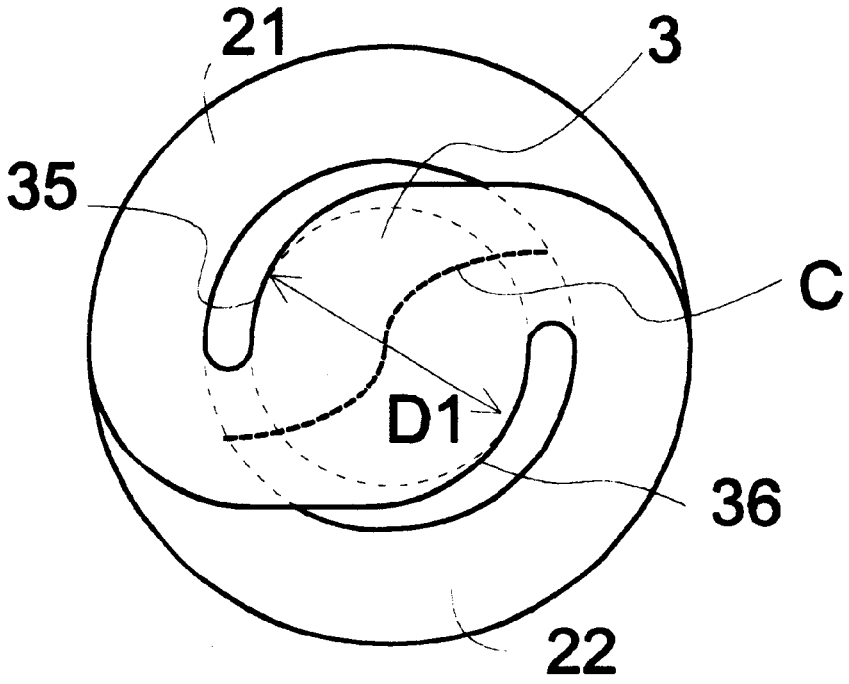
FIG. 3 is a top view of another spiral shaped lamp with a slightly differently shaped cold chamber.

FIG. 3 shows another possible form of the cold chamber portion 3. In this case, the opposing wall sections 35,36 are not exactly concentric, and their radius is slightly larger as compared to the embodiment shown in FIG. 2. This small change means that the visual appearance of the cold chamber portion 3 is different, so that connecting end portions 41,42 of the tube portions 21,22 and the cold chamber portion 3 are substantially S-shaped in a plane perpendicular to the central axis A of the discharge tube 2. This form is even more apparent on the embodiment shown in FIG. 4.

The S-shaped appearance of the cold chamber portion is also enhanced because the connecting end portions 41,42 of the tube portions 21,22 and the cold chamber portion 3 has a substantially S-shaped centre line C in a plane perpendicular to the central axis A of the discharge tube 2. The S-shaped centre line C ensures that the path of the discharge arc is free from sudden turns, and thereby the thermal load on the glass wall is evenly distributed. The S-shaped continuous connection between the tube portions 21,22 is also advantageous from a mechanical point, because the glass wall of the discharge tube 2 is free from curved surfaces with has a small radius of curvature and which are facing outwards. Such points are particularly prone to internal stresses, and it is also more difficult to control the wall thickness at such locations.

Figure 4:
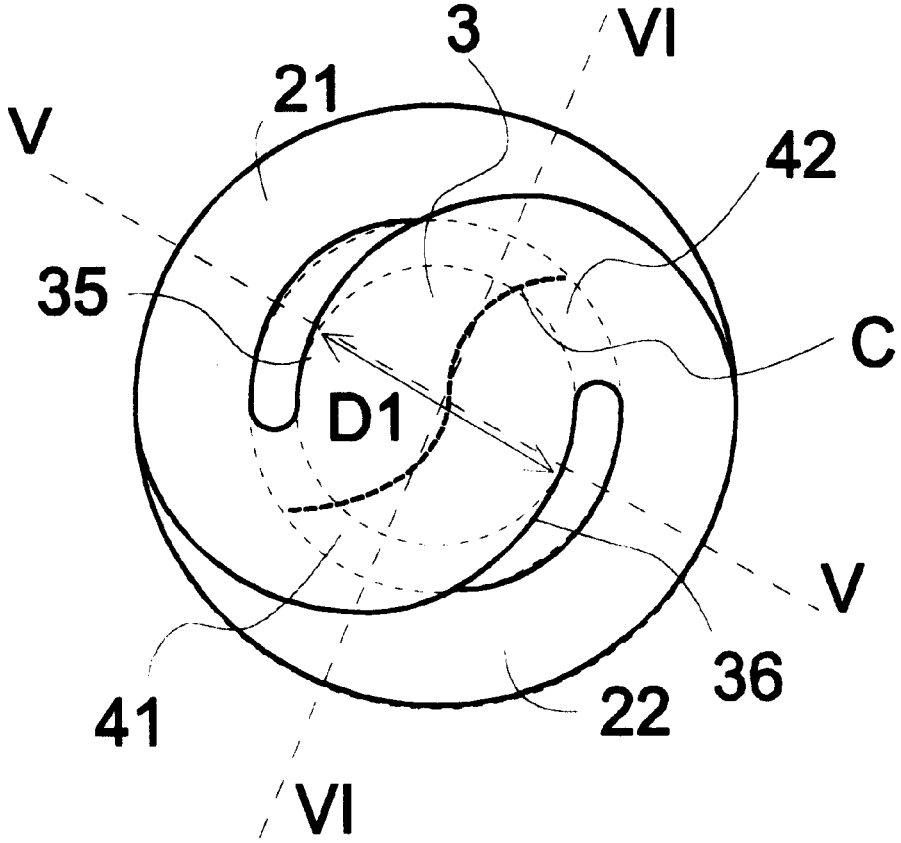
FIG. 4 is a top view of yet another spiral shaped lamp with an S-formed cold chamber.

The cross sections of the cold chamber portion 3 of the lamp shown in FIG. 4 are presented in FIGS. 5 and 6, taken along two perpendicular planes.

As it is apparent from FIG. 5, the cold chamber portion 3 has an elliptic cross section in a plane parallel to the central axis A of the discharge tube and perpendicular to the centre line C of the cold chamber portion 3. However, the surface 37 of the cold chamber portion 3 facing the inside of the double spiral is not a convex surface, but a saddle surface, i. e. the curvature of the surface in transverse directions has opposite signs. This may be perceived also by comparing FIGS. 5 and 6. In the latter, it is seen that the cold chamber portion 3 has a substantially bean-shaped cross section in a plane parallel to the central axis A of the discharge tube 2 and substantially tangential to the centre line C of the cold chamber portion 3 at the centre of the cold chamber portion. The centre of the cold chamber portion 3 may be considered to be the point where the S-shaped centre line C has an inflection point.

FIGS. 5 and 6 also show clearly that the a first transversal dimension D1 of the cold chamber portion 3, in effect the width thereof, is larger than the diameter d of the tube portions 21,22, while the second transversal dimension D2 of the cold chamber portion 3, which may be regarded as the height of the cold chamber portion 3 when the lamp is positioned as in FIG. 1, substantially corresponds to the diameter d of the tube portions 21,22.

It is also seen in FIGS. 5 and 6 that an enveloping surface E of the cold chamber portion 3 and the connecting end portions 41,42 of the tube portions 21,22 is substantially spherical. This has the advantage that the light distribution and overall shape of the lamp 1 better approaches those of traditional incandescent bulbs. However, the enveloping surface may be flat as well in the top region, particularly when circular cold chambers are used, as with the lamp illustrated in FIGS. 1 and 2.

It is also foreseen that the surface of the cold chamber portion facing the inside of the double spiral is a concave surface. Such an embodiment may be preferred if the external surface of the cold chamber portion should be even larger. Such a concave surface may be achieved if the cold chamber portion of a lamp has a substantially bean-shaped cross section not only in a plane substantially tangential to the centre line of the cold chamber portion, but also perpendicular to this centre line. Such a lamp with a concave or re-entrant lower external surface on its cold chamber portion is otherwise similar to the lamp shown in FIGS. 4 and 6.

It is possible to form the shown cold chamber portions of the discharge tube in a casting mould.

The configuration of the cold chamber portion according to the invention results in a more stable operation of the lamp 1 as compared with the known spiral-shaped low pressure gas discharge lamps. It is noted that the location of the cold spot in the cold chamber portion and its desired 37° C. temperature at a room temperature of 24° C. is influenced not only by the arrangement of the gas discharge path within the discharge tube 2, but also by the external air stream conveying the heat generated by the gas discharge lamp. In case of the vertical positioning of the discharge lamp 1, as shown on FIG. 1, the air stream is heating the cold chamber situated on the top of the lamp. The external air stream heats the increased external surface of the cold chamber to a less extent. On the other hand, the probability that the external air stream uniformly heats the cold chamber is very low, and a definite cold point is created under any circumstances.

The embodiment shown in the figures is a lamp with a terminal which fits into a screw-in type of socket (also called as an Edison-type socket). However, the lamp may have other types of terminal. Notably, a so-called plug-in type of terminal and socket is commonly used with compact fluorescent lamps. It is also known to place the ballast electronics in a housing different from the housing supporting the discharge tube, so that the defunct discharge tube may be discarded, but the expensive electronics components of the ballast can be used further with another discharge tube. In this case there is also a socket-type connection between the two housings, facilitating the replacement of the discharge tube.

The suggested spiral-shaped low pressure gas discharge lamp has several advantages. A cold chamber with a disk-like or S-like shape is formed in at the ends of the helically wound gas discharge tube portions, and the suggested shape of the cold chamber makes it possible to adjust the partial vapour pressure of mercury to match the resonance level of the highest emission. As a result, the luminous flux performance of the gas discharge lamp can be stabilised at the highest possible level. At the same time, the cold chamber portion at the central axis functions as a large luminous surface, while maintaining the structural integrity of the discharge tube. Further, the discharge lamp also has an aesthetic and pleasing appearance.

The invention is not limited to the shown and disclosed embodiments, but other elements, improvements and variations are also within the scope of the invention.

What is claimed is:

1. A low-pressure discharge lamp comprising a double spiral shaped discharge tube including two spiral shaped tube portions, the tube portions defining a central axis of the discharge tube, the lamp further comprising a cold chamber portion connecting the ends of the spiral shaped tube portions;

the cold chamber portion having a first transversal dimension substantially perpendicular to the central axis, the first transversal dimension of the cold chamber portion being larger than the diameter of the tube portions; and further the cold chamber portion having a second transversal dimension substantially parallel to the central axis, the second transversal dimension of the cold chamber portion substantially corresponding to the diameter of the tube portions.

2. The discharge lamp of claim 1 in which the cold chamber portion has a substantially circular cross section in a plane substantially perpendicular to the central axis, the cold chamber having a diameter larger than the diameter of the tube portions.

3. The discharge lamp of claim 2 in which the diameter of the cold chamber portion is smaller than the inner diameter of the double spiral.

4. The discharge lamp of claim 2 in which at least a wall section of the cold chamber portion is concentric with an opposing wall section, and the diameter of the cold chamber is defined as the distance between the concentric wall sections.

5. The discharge lamp of claim 1 in which the cold chamber portion has an elliptic cross section in a plane parallel to the central axis of the discharge tube and perpendicular to a centre line of the cold chamber portion.

6. The discharge lamp of claim 1 in which the surface of the cold chamber portion facing the inside of the double spiral is a saddle surface.

7. The discharge lamp of claim 6 in which the cold chamber portion has a substantially bean-shaped cross section in a plane parallel to the central axis of the discharge tube and substantially tangential to the centre line of the cold chamber portion at the centre of the cold chamber.

8. The discharge lamp of claim 1 in which the surface of the cold chamber portion facing the inside of the double spiral is a concave surface.

9. The discharge lamp of claim 8 in which the cold chamber portion has a substantially bean-shaped cross section in a plane parallel to the axis of the discharge tube and perpendicular to a centre line of the cold chamber portion.

10. The discharge lamp of claim 1 in which connecting end portions of the tube portions and the cold chamber portion are substantially S-shaped in a plane perpendicular to the central axis of the discharge tube.

11. The discharge lamp of claim 10 in which the connecting end portions of the tube portions and the cold chamber portion has a substantially S-shaped centre line in a plane perpendicular to the central axis of the discharge tube.

12. The discharge lamp of claim 1 in which an enveloping surface of the cold chamber portion and connecting end portions of the tube portions is substantially spherical.

13. The discharge lamp of claim 1 in which an inside surface of the cold chamber portion is covered with light emitting material.

* * * * *